US007703223B2

(12) United States Patent
Walker et al.

(10) Patent No.: US 7,703,223 B2
(45) Date of Patent: Apr. 27, 2010

(54) MOTORIZED SNOWBLOWER CHUTE CONTROL ASSEMBLY AND RELATED METHODS

(75) Inventors: Christopher Todd Walker, Hillsborough, NC (US); Scott J. Kaskawitz, Burlington, NC (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/128,759

(22) Filed: May 29, 2008

(65) Prior Publication Data

US 2009/0293321 A1 Dec. 3, 2009

(51) Int. Cl.
*E01H 5/09* (2006.01)

(52) U.S. Cl. ..... 37/260; 37/244; 37/248; 37/249; 37/251; 37/261

(58) Field of Classification Search ..... 37/260, 37/244, 248–253, 257–259, 261
See application file for complete search history.

(56) References Cited

U.S. PATENT DOCUMENTS

| | | | | | |
|---|---|---|---|---|---|
| 3,075,813 | A * | 1/1963 | Vohl | 406/158 |
| 3,241,253 | A * | 3/1966 | McKee | 37/228 |
| 3,251,631 | A * | 5/1966 | Hennen | 406/161 |
| 3,334,429 | A * | 8/1967 | Price | 37/243 |
| 3,726,029 | A * | 4/1973 | Deen et al. | 37/261 |
| 3,742,626 | A | 7/1973 | Ellis | |
| 4,011,668 | A | 3/1977 | Gunderson | |
| 4,068,397 | A | 1/1978 | Bacon | |
| 4,072,359 | A | 2/1978 | Lillkvist | |
| 4,391,052 | A * | 7/1983 | Guy, Jr. | 37/236 |
| 4,862,607 | A | 9/1989 | Wacker | |
| D307,912 | S | 5/1990 | Yoshida et al. | |
| 5,444,927 | A * | 8/1995 | Sosenko | 37/260 |
| 5,735,064 | A | 4/1998 | Holl | |
| 6,487,798 | B2 | 12/2002 | Sueshige | |
| 6,499,238 | B2 * | 12/2002 | Kluck et al. | 37/261 |
| 6,502,335 | B2 | 1/2003 | Prochnow et al. | |
| 6,662,477 | B2 | 12/2003 | Dowe et al. | |
| 6,718,746 | B2 * | 4/2004 | Hettiger et al. | 56/11.7 |
| D498,770 | S | 11/2004 | Yuzuriha | |
| 6,834,448 | B2 | 12/2004 | Hanafusa | |
| 7,032,333 | B2 * | 4/2006 | Friberg et al. | 37/260 |
| 7,121,021 | B2 | 10/2006 | Sakai | |
| 7,155,847 | B2 | 1/2007 | Kuroiwa et al. | |
| 7,165,345 | B2 | 1/2007 | Beaudoin | |
| 7,174,660 | B2 | 2/2007 | Sakai et al. | |
| 7,194,827 | B2 | 3/2007 | Mercer et al. | |

(Continued)

*Primary Examiner*—Thomas A Beach
*Assistant Examiner*—Matthew R Buck
(74) *Attorney, Agent, or Firm*—Jenkins, Wilson, Taylor & Hunt, P.A.

(57) ABSTRACT

A chute control assembly and related methods for mounting a motor to a snowblower are disclosed, wherein the motor is capable of being operated to rotate the chute of the snowblower. The motor and a chute bottom holding bracket can be preassembled so that the assembly can then be slipped over the chute gear for final assembly. The motor can receive electrical impulses from the movement of a standard control handle mounted on the snowblower. The electrical impulses can cause the motor to rotate a worm gear or pinion in either direction depending on the movement of the handle. The worm gear or pinion can rotate a gear chute in an appropriate direction, thereby rotating the chute of the snowblower.

21 Claims, 4 Drawing Sheets

U.S. PATENT DOCUMENTS 7,540,102 B2 * 6/2009 Olmr et al. ..... 37/245
2003/0000304 A1 * 1/2003 Wetor ..... 73/305
2007/0062076 A1 * 3/2007 Majkrzak ..... 37/249

* cited by examiner

MOTORIZED SNOWBLOWER CHUTE CONTROL ASSEMBLY AND RELATED METHODS

TECHNICAL FIELD

The subject matter described herein relates generally to motor-driven gear assemblies. More particularly, the subject matter disclosed herein relates to motor-driven gear assemblies used to control the rotation of a snowblower chute.

BACKGROUND

When using a snowblower to remove snow, a user will often move in a first linear direction until reaching the end of some real or imaginary boundary. By doing so, the user throws snow in a consistent direction, usually to the side of the directional movement. After reaching the boundary, the user will generally turn the snowblower 180° and continue to remove snow by moving in a direction opposite of the first linear direction. During this return, the snow is thrown in a direction opposite that of when the user was moving in the first linear direction. As such, snow is thrown in areas that may have already been passed over by the snowblower and were clear of snow. To prevent such problems, snowblowers often include means for rotating a snowblower chute so that snow can be thrown in a consistent direction no matter which direction the snowblower is being directed.

Typically, snowblower chute controls can be mechanical or electrical mechanisms. Mechanical controls can have a gear system in which a control handle is connected to the gear system for rotating the snowblower chute. A crank shaft, for example, can be used to transfer rotational motion from a shaft to a gear system that is directly configured to the snowblower chute for rotational movement. Electrical controls can typically include a joystick-type control handle that is mechanically linked to a gear system configured directly to the snowblower chute. Thus, movement of the joystick-type control handle elicits movement on the snowblower chute.

Electrical chute controls provide an obvious advantage over purely mechanical systems in that the user need only trigger an electrical input to drive the rotation of the snowblower chute. Electrical controls can often be complex systems, however, having a variety of interlinking electrical, mechanical, hydraulic, and/or structural components. As a result, the complexity of these systems can contribute to costly and time-consuming assembly. Thus, it would be advantageous to have an electrical snowblower chute control system that minimizes the number of separate components to reduce time spent—and thus help reduce the cost—of assembling the snowblower chute control mechanism.

Therefore, improved snowblower chute controls are provided for electrically controlling the rotation of a snowblower chute with an easy-to-assemble control mechanism.

SUMMARY

In accordance with this disclosure, novel motorized snowblower chute assemblies and methods are provided.

It is therefore an object of the present disclosure to provide novel motorized snowblower chute assemblies and methods that facilitate rotational control of a snowblower chute but that provide for easy assembly of the snowblower chute control system. This and other objects as may become apparent from the present disclosure are achieved, at least in whole or in part, by the subject matter described herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Reference will now be made in detail to the description of the present subject matter, one or more examples of which are shown in the figures. Each example is provided to explain the subject matter and not as a limitation. Features illustrated or described as part of one embodiment can be used in another embodiment to yield still a further embodiment. It is intended that the present subject matter cover such modifications and variations.

Figure 1:
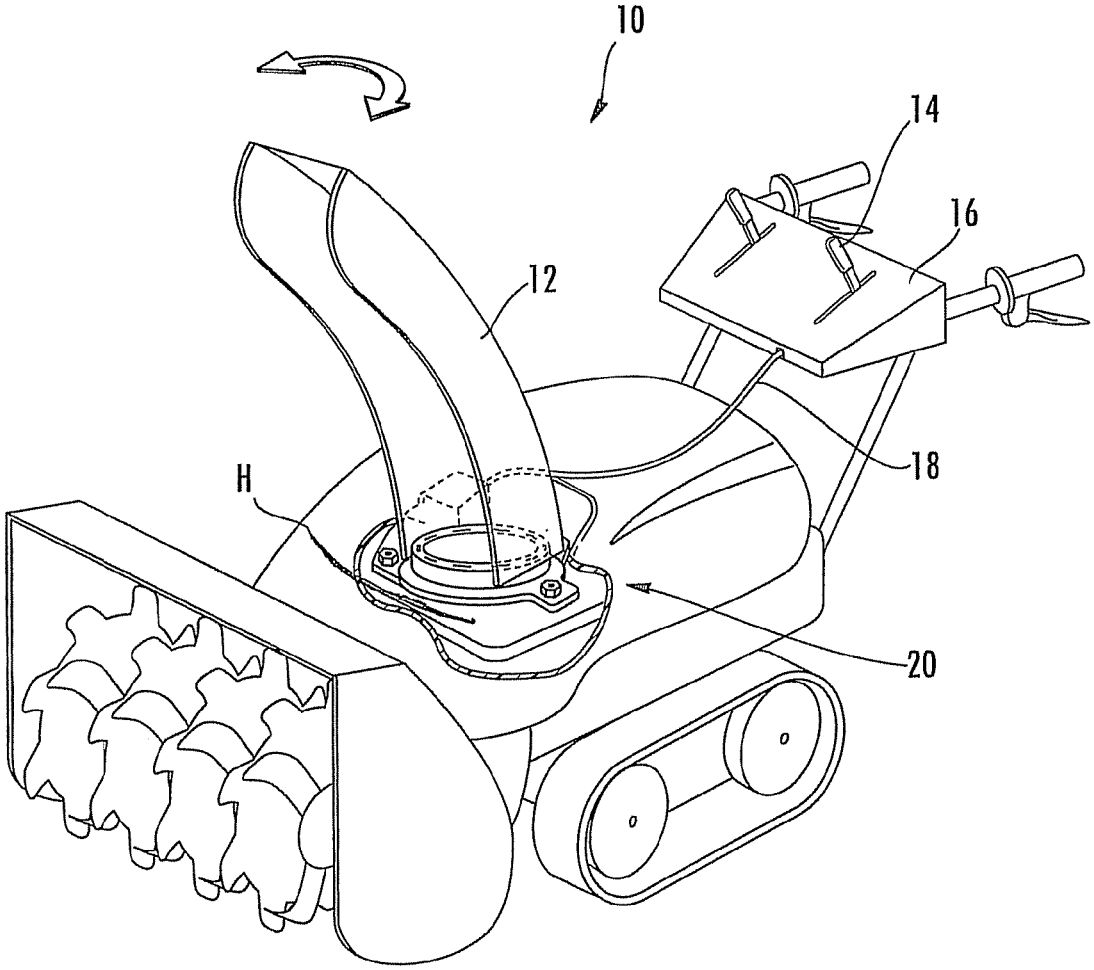
FIG. 1 illustrates a perspective view of an embodiment of a snowblower incorporating a chute gear bracket according to the present subject matter.

FIG. 1 illustrates a snowblower, generally designated 10, incorporating one embodiment of a motor-driven snowblower chute control assembly, generally designated 20, that can be positioned for example at the base of a rotatable discharge chute 12 of snowblower 10. Chute control assembly 20 can be controlled by operating a chute control such as chute control 14 on a control panel 16 of snowblower 10. Operating chute control 14 can send an electrical signal to chute control assembly 20 via any suitable structure such as a harness or a cable 18 to cause rotational movement of discharge chute 12.

Figure 2:
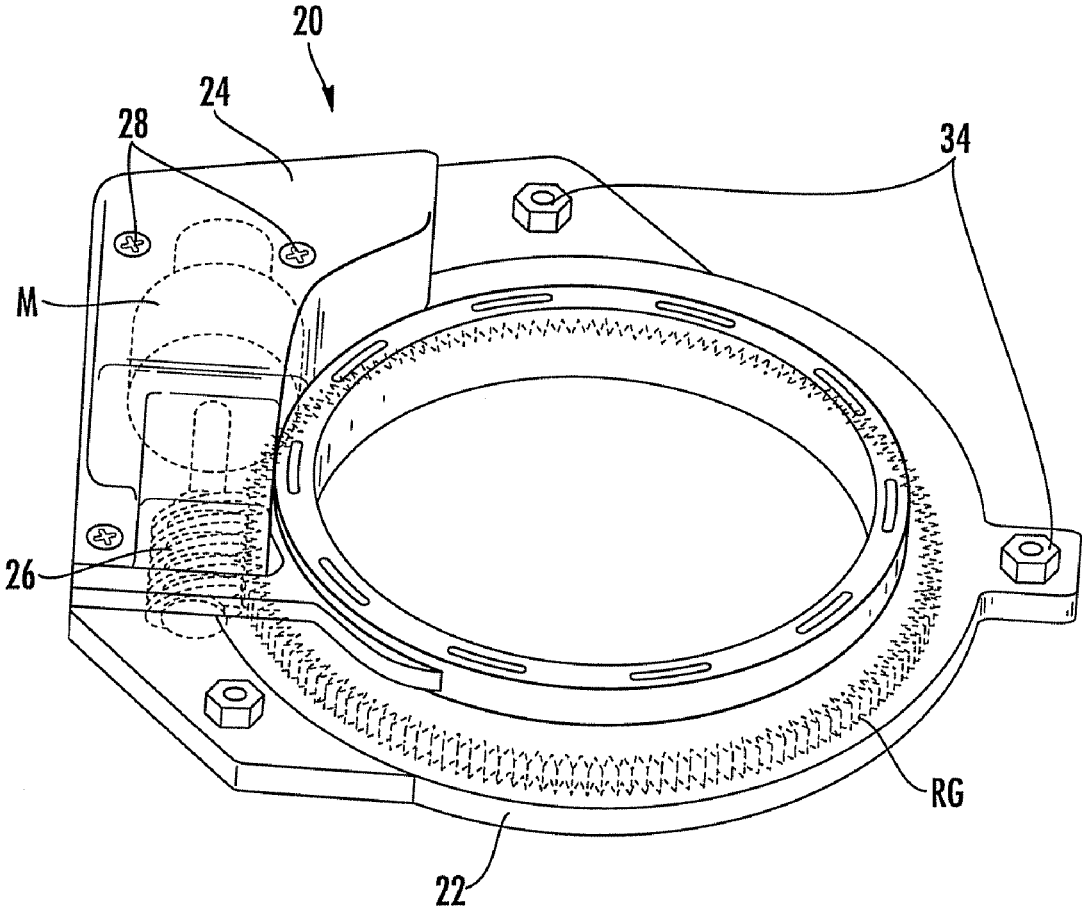
FIG. 2 illustrates a perspective view of an embodiment of the chute gear bracket according to the present subject matter.
Figure 3:
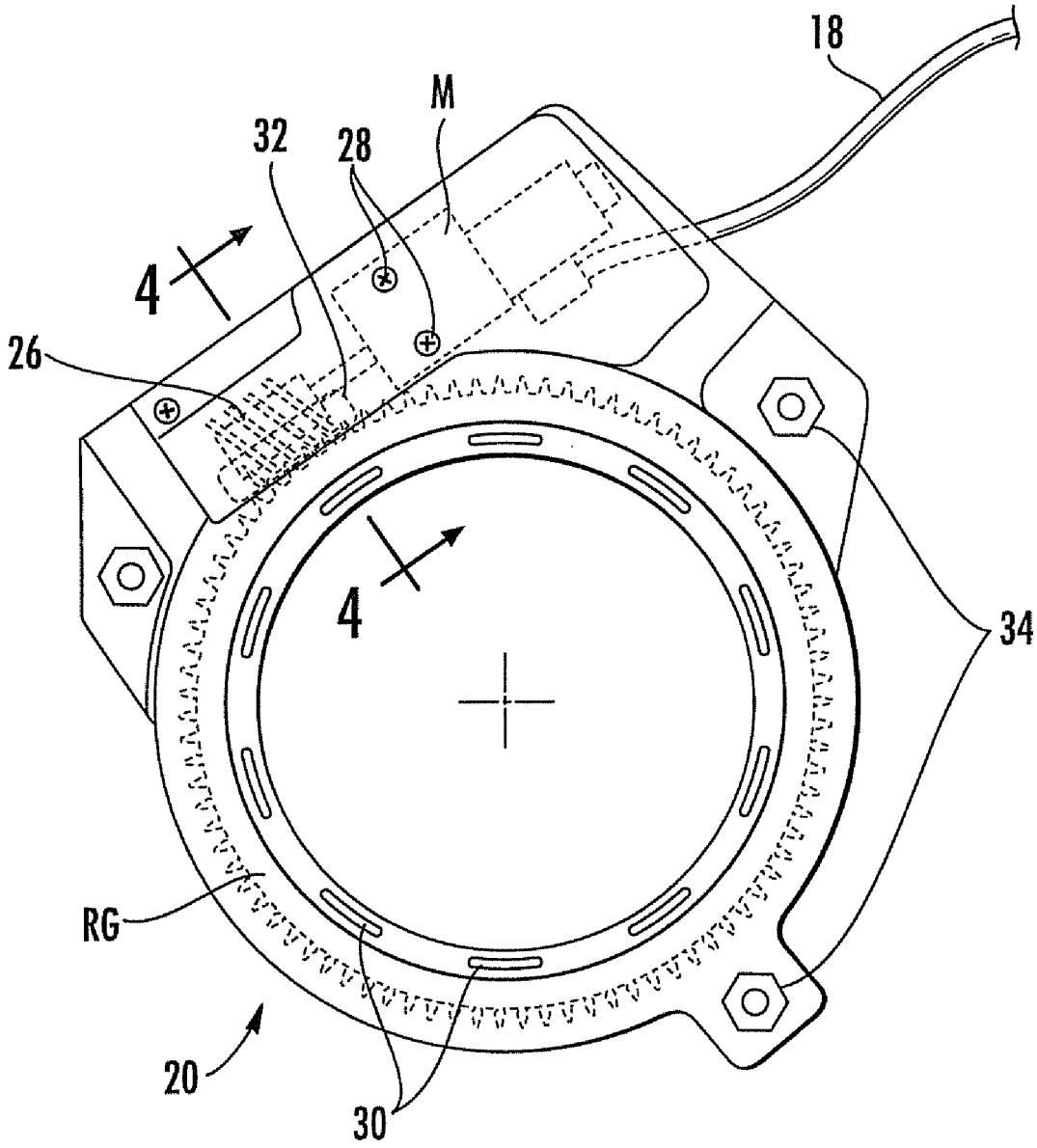
FIG. 3 illustrates a plan view of an embodiment of the chute gear bracket according to the present subject matter.
Figure 4:
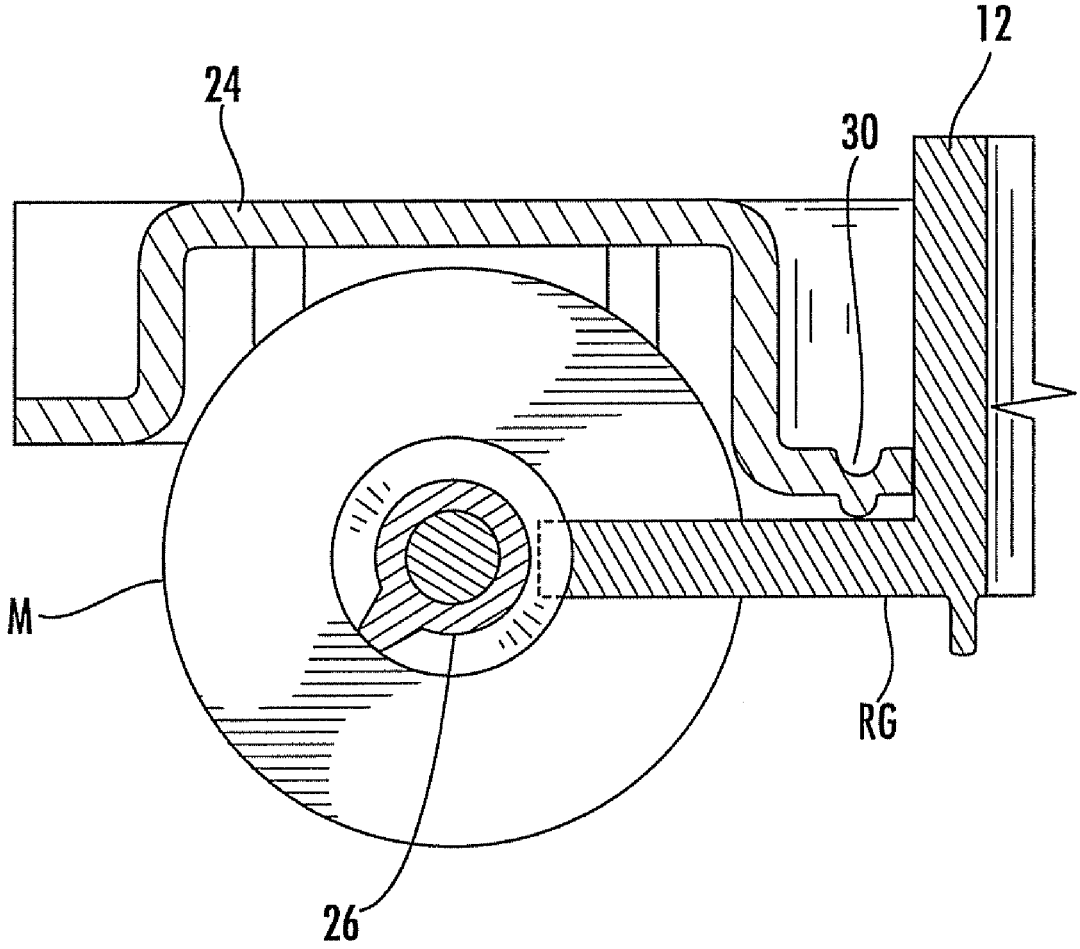
FIG. 4 illustrates a partial elevation cross-sectional view of an embodiment of the chute gear bracket according to the present subject matter.

Chute control assembly 20 according to the present subject matter is shown in more detail in FIGS. 2-4. Chute control assembly 20 can include a chute-holding bracket 22 to secure discharge chute 12 against snowblower 10, such as against the housing H of snowblower 10. As is illustrated in FIGS. 2 and 3, chute-holding bracket 22 can be a substantially ring-shaped bracket designed to be positioned about the base of discharge chute 12 to secure discharge chute 12 in place.

Chute control assembly 20 can further include a flange 24 that can extend outwardly and upwardly from chute-holding bracket 22, and can create a recess between flange 24 and housing H of snowblower 10. A motor M can be secured to flange 24 between flange 24 and housing H of snowblower 10. Motor M can then be coupled to a ring gear RG secured at or near the base of discharge chute 12. Specifically, a drive gear 26 driven by motor M can be meshingly engaged with the teeth of ring gear RG. Any known design capable of providing driving engagement of ring gear RG by motor M can be used, such as, for example, a worm or a pinion. Drive gear 26 is illustrated in FIGS. 2-4 as a worm.

As is illustrated in FIG. 3, motor M can be connected to chute control 14 on control panel 16 via cable 18. In this configuration, operation of chute control 14 by the user activates motor M to engage drive gear 26 with ring gear RG to drive the rotation of discharge chute 12. Motor M can be reversible such that drive gear 26 can be driven in either a clockwise or counter-clockwise direction to thereby cause rotation of discharge chute 12 in either direction. Manipulation of chute control 14 can allow the user to dictate the direction of rotation. Chute control assembly 20 can further be configured such that discharge chute 12 can be rotatable about a range of at least 210 degrees to allow discharge chute 12 to be rotated to direct snow in a forward direction, to either side of snowblower 10, or in any direction therebetween.

The particular configuration of chute control assembly 20 as described hereinabove and illustrated in the figures enables chute control assembly 20 to be quickly and easily assembled and attached to housing H of snowblower 10. Specifically, chute control assembly 20 can be assembled independently from the rest of snowblower 10 and then coupled to snowblower 10 with minimal difficulty. For example, motor M can first be attached to chute-holding bracket 22. This attachment can be accomplished, for example, by securing motor M to flange 24 that extends from chute-holding bracket 22. For instance, motor M can be secured to flange 24 using mounting screws 28.

Separately, discharge chute 12 can be rotatably positioned on housing H. Pre-assembled chute control assembly 20 can then be positioned about discharge chute 12, for example by slipping ring-shaped chute-holding bracket 22 over discharge chute 12. Ring gear RG can thus be restrained between chute-holding bracket 22 and housing H, thereby restraining discharge chute 12 against housing H and rotatably coupling discharge chute 12 to snowblower 10. Chute-holding bracket 22 can include a plurality of indents 30 that can be positioned over ring gear RG about the perimeter of chute-holding bracket 22. Indents 30 can help to stabilize discharge chute 12 as it rotates against housing H. Chute control assembly 20 can include a window 32 in flange 24 positioned generally above drive gear 26, allowing the user to observe the coupling of drive gear 26 to ring gear RG to ensure meshing engagement. Alternatively, chute control assembly 20 can be coupled to discharge chute 12 before it is positioned on housing H of snowblower 10.

Once chute control assembly 20 is positioned about discharge chute 12 with drive gear 26 meshingly engaged with ring gear RG, chute control assembly 20 can be secured to housing H by any suitable fasteners such as fasteners 34 to secure discharge chute 12 in place against housing H. For example, one or more weld nuts can be used to secure chute-holding bracket 20 to housing H. Motor M can be electrically connected to chute control 14 on control panel 16 using cable 18.

Embodiments of the present disclosure shown in the drawings and described above are exemplary of numerous embodiments that can be made within the scope of the appending claims. It is contemplated that the configurations described herein can comprise numerous configurations other than those specifically disclosed. The scope of a patent issuing from this disclosure will be defined by these appending claims.

What is claimed is:

1. A snowblower chute assembly comprising:

a rotatable discharge chute of a snowblower;

a chute-holding bracket securing the discharge chute to the snowblower, the chute-holding bracket at least partially defining an opening therethrough for communicating with the discharge chute;

a ring gear positioned below the chute-holding bracket and attached to the discharge chute; and a motor secured to the chute-holding bracket, the motor coupled to the ring gear whereby operation of the motor drives rotation of the ring gear and the discharge chute.

2. The snowblower chute assembly of claim 1, further comprising:

a drive gear coupled to the motor and engaged with the ring gear;

wherein operation of the motor drives the drive gear, which correspondingly drives rotation of the ring gear and discharge chute.

3. The snowblower chute assembly of claim 2, wherein the drive gear comprises a pinion.

4. The snowblower chute assembly of claim 2, wherein the drive gear comprises a worm.

5. The snowblower chute assembly of claim 2, wherein the chute-holding bracket comprises a window positioned above the drive gear such that engagement of the drive gear to the ring gear can be observed.

6. The snowblower chute assembly of claim 1, further comprising one or more fasteners securing the motor to the chute-holding bracket.

7. The snowblower chute assembly of claim 1, further comprising one or more fasteners securing the chute-holding bracket to the snowblower.

8. The snowblower chute assembly of claim 1, wherein the discharge chute is rotatable about a range of at least 210 degrees.

9. The snowblower chute assembly of claim 1, further comprising a flange extending outwardly and upwardly from the chute-holding bracket, the motor being secured to a bottom surface of the flange.

10. A walk-behind snowblower comprising:

a snowblower housing;

a discharge chute rotatable on the snowblower housing;

a ring gear attached at an end of the discharge chute nearest to the snowblower housing;

a drive gear meshingly engagable with the ring gear;

a motor drivingly coupled to the drive gear;

a chute-holding bracket secured to the motor, wherein the chute-holding bracket is positioned above the ring gear and restrains the discharge chute against the snowblower housing;

a flange extending outwardly and upwardly from the chute-holding bracket, the flange creating a recess between the flange and the snowblower housing; and a control handle connected to the motor.

11. The walk-behind snowblower of claim 10, further comprising a harness connecting the motor to the control handle.

12. The walk-behind snowblower of claim 10, wherein the motor is positioned beneath the flange, and wherein the motor is operable for driving rotation of the drive gear in both clockwise and counter-clockwise directions.

13. The walk-behind snowblower of claim 12, wherein the direction of rotation of the motor is controllable by manipulation of the control handle.

14. An assembly for attachment to a discharge chute of a snowblower, the assembly comprising:

a motor for operative connection with a rotatable discharge chute of a snowblower for rotatably driving the discharge chute;

a chute-holding bracket pre-assembled to the motor, the bracket being configured for attachment to restrain the discharge chute against the snowblower, the chute-holding bracket being positioned above the ring gear, and the chute-holding bracket at least partially defining an opening therethrough for communicating with the discharge chute; and a ring gear positioned below the chute-holding bracket for operative connection with the motor to rotate the discharge chute.

15. The assembly of claim 14, wherein the discharge chute is rotatable about a range of at least 210 degrees.

16. The assembly of claim 14, further comprising:

a drive gear coupled to the motor and engaged with the ring gear;

wherein operation of the motor drives the drive gear, which correspondingly drives rotation of the ring gear and discharge chute.

17. The assembly of claim 14, wherein the chute-holding bracket comprises:

a flange extending outwardly and upwardly from the chute-holding bracket, the motor being connected to a bottom surface of the flange; and a window in the flange positioned above the drive gear such that engagement of the drive gear to the ring gear can be observed.

18. The assembly of claim 14, further comprising one or more fasteners securing the chute-holding bracket to the snowblower.

19. A method for assembling a snowblower chute comprising:

attaching a motor to a chute-holding bracket that has a flange extending outwardly and upwardly from the chute-holding bracket the motor being coupled to a drive gear;

positioning the chute-holding bracket about a discharge chute of a snowblower where the discharge chute is secured against the snowblower by the chute-holding bracket and the chute-holding bracket is positioned above a ring gear operatively connected with the motor and the discharge chute to rotate the discharge chute.

20. The method for assembling a snowblower chute of claim 19, further comprising securing the chute-holding bracket to the snowblower using fasteners.

21. The method for assembling a snowblower chute of claim 19, further comprising electrically connecting the motor to a control handle controllable by a snowblower operator.

* * * * *